US007797800B2

(12) United States Patent
Beltramello

(10) Patent No.: US 7,797,800 B2
(45) Date of Patent: Sep. 21, 2010

(54) BUCKLE FOR CONNECTING A WRIST STRAP TO THE HANDGRIP OF A POLE FOR USE IN SPORTING ACTIVITIES

(75) Inventor: Marta Beltramello, Bassano Del Grappa (IT)

(73) Assignee: Gabel, S.r.l., Rosa' (VI) (IT)

( * ) Notice: Subject to any disclaimer, the term of this patent is extended or adjusted under 35 U.S.C. 154(b) by 494 days.

(21) Appl. No.: 11/605,650

(22) Filed: Nov. 29, 2006

(65) Prior Publication Data

US 2007/0119031 A1 May 31, 2007

(30) Foreign Application Priority Data

Nov. 30, 2005 (IT) ..... VI2005A0318

(51) Int. Cl.
*A44B 11/12* (2006.01)
*A63C 11/22* (2006.01)
*B25G 1/00* (2006.01)

(52) U.S. Cl. ..... 24/170; 24/168; 24/265 BC; 280/821

(58) Field of Classification Search ..... 24/265 EC, 24/265 BC, 168, 169, 170, 129 R, 129 W, 24/129 A, 134 N, 134 L, 132 R; 280/821, 280/822
See application file for complete search history.

(56) References Cited

U.S. PATENT DOCUMENTS

| | | | | |
|---|---|---|---|---|
| 2,149,550 | A | 3/1939 | Richards et al. | |
| 3,050,578 | A * | 8/1962 | Huebner | 24/17 AP |
| 3,149,386 | A * | 9/1964 | Trundy | 24/707.7 |
| 3,658,356 | A | 4/1972 | Ven Reyper | |
| 3,896,527 | A * | 7/1975 | Miller et al. | 24/132 R |
| 4,130,293 | A * | 12/1978 | Hinterreiter | 280/822 |
| 4,288,100 | A * | 9/1981 | Aho | 280/821 |
| 4,288,101 | A * | 9/1981 | Aho | 280/821 |
| 4,387,490 | A * | 6/1983 | Blackburn et al. | 24/198 |
| 4,416,036 | A | 11/1983 | Aho | |
| 6,044,527 | A * | 4/2000 | Ishida et al. | 24/129 R |
| 6,349,904 | B1 * | 2/2002 | Polad | 24/16 PB |
| 6,581,885 | B2 * | 6/2003 | Polad | 24/16 PB |
| 6,725,506 | B1 * | 4/2004 | Anscher | 24/170 |
| 2004/0134039 | A1 * | 7/2004 | Tracy | 24/3.4 |

FOREIGN PATENT DOCUMENTS

DE 3205184 A1 9/1982

* cited by examiner

*Primary Examiner*—Robert J Sandy
(74) *Attorney, Agent, or Firm*—IP Strategies

(57) ABSTRACT

A buckle for connecting a wrist strap to the handgrip of a pole for sporting activities such as skiing, trekking and the like includes a body consisting of an outer jaw and an inner jaw between which it is possible to identify locking means suited to cooperate with a tape forming part of the strap and arranged in different positions between the outer jaw and the inner jaw in order to retain the strap at different distances from the handgrip.

12 Claims, 5 Drawing Sheets

BUCKLE FOR CONNECTING A WRIST STRAP TO THE HANDGRIP OF A POLE FOR USE IN SPORTING ACTIVITIES

BACKGROUND OF THE INVENTION

The present invention relates to a buckle for the adjustable connection of a wrist strap to the handgrip of a pole for use in sporting activities, e.g. skiing, trekking and the like.

There are known types of pole used in the above-mentioned sporting activities that comprise a handgrip for the user to hold, complete with a wrist strap that can be adjusted to suit the athlete's hand and the conditions in which the pole is used.

The wrist strap is preferably composed of a flexible material and associated with a buckle by means of a tape. Said buckle is suitably shaped so that it can be inserted inside a recess provided on the top end of the handgrip of the pole.

Before grasping the handgrip, the athlete places his/her hand through the loop created by the wrist strap and adjusts the length of said strap so that it is retained in the most suitable position for using the pole.

As for the connection between the wrist strap and the buckle, this is provided, as mentioned earlier, by means of a tape that extends from the wrist strap and is contained inside the buckle.

All the buckles carried out according to the known state of the art have several acknowledged drawbacks.

The first of these drawbacks is represented by the fact that the tape is permanently associated with the inside of the buckle, so that it is impossible to vary the mutual distance between the wrist strap and the handgrip.

This may be a nuisance to the user because it may oblige him/her to hold his/her wrist and hand in an unsuitable position with respect to the handgrip. Moreover, an unsuitable distance between the user's hand and the handgrip may prevent the user from rapidly regaining his/her hold after losing control of the pole.

The object of the present invention is to overcome all the above-mentioned drawbacks.

SUMMARY OF THE INVENTION

In particular, a first object of the present invention is to produce a buckle for connecting a wrist strap to the handgrip of a pole used for sporting activities that enables the user to adjust the distance between the wrist strap and the handgrip so as to ensure the most suitable posture for the user's wrist and hand.

Another object of the present invention is to produce a buckle that facilitates the user in regaining control of said handgrip as rapidly as possible in the event of losing hold of the pole.

The aforesaid objects have been achieved through the construction of a buckle for connecting a wrist strap to the handgrip of a pole used for sporting activities, e.g. skiing, trekking and the like, that, according to the contents of the main claim, is characterised in that it has a body consisting of an outer jaw and an inner jaw with locking means between them that are suitable for co-operating with a tape forming part of said wrist strap and arranged in different positions between said jaws, thereby attaching said wrist strap at different distances from said handgrip.

The aforesaid objects have also been achieved through the construction of a wrist strap for the handgrip of a pole used for sporting activities, e.g. skiing, trekking and the like, of the type comprising a tape associated with a buckle for connecting the wrist strap to said handgrip, wherein said buckle consists of a body comprising at least two opposing elements with locking means suitable for fixing in different positions a tape forming part of said strap and arranged in different positions between said jaws in order to retain said strap at different distances from said handgrip.

According to the preferred embodiment of the invention, the buckle has fixing means that retain it inside a recess provided in the handgrip.

The presence of locking means that make it possible to modify the mutual position of the tape and the buckle advantageously enables the user to adjust the distance between the wrist strap and the handgrip.

Another advantage lies in that the insertion of the buckle inside the recess provided in the handgrip prevents any accidental changes in said adjustment while the user is making use of the pole.

BRIEF DESCRIPTION OF THE DRAWINGS

The aforesaid advantages and others that will be described in greater detail below will become more evident from the description of preferred embodiments of the invention provided herein as non-restrictive examples with reference to the attached drawings, wherein.

DESCRIPTION OF THE INVENTION

Figure 1:
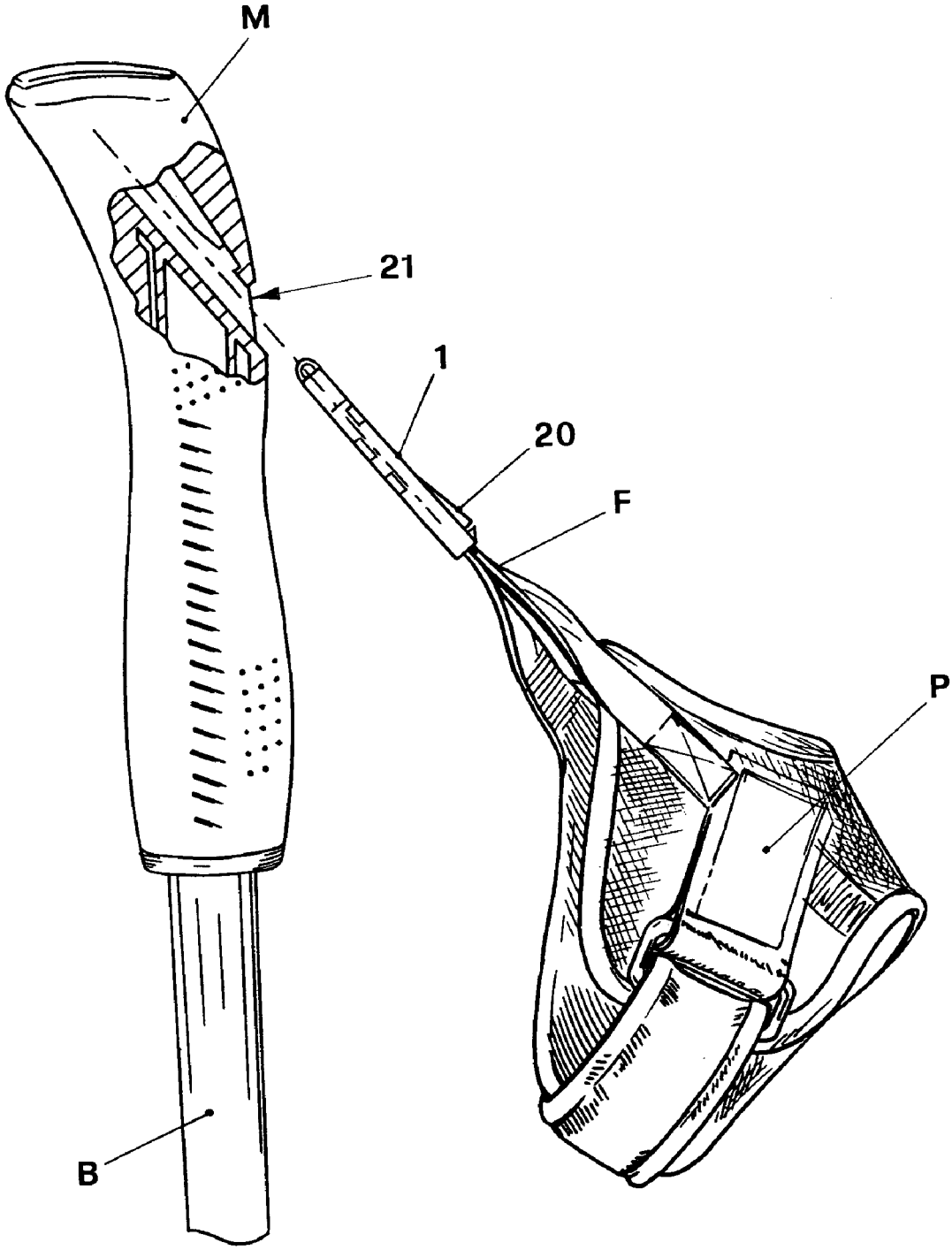
FIG. 1 shows an example of the application of the buckle carried out according to the invention.

The buckle that is the subject of the invention is illustrated in FIG. 1, where it is indicated as a whole by the numeral 1 and where it is evident that it connects a wrist strap P to the handgrip M of a pole B for use in sporting activities.

Figures 2, 5:
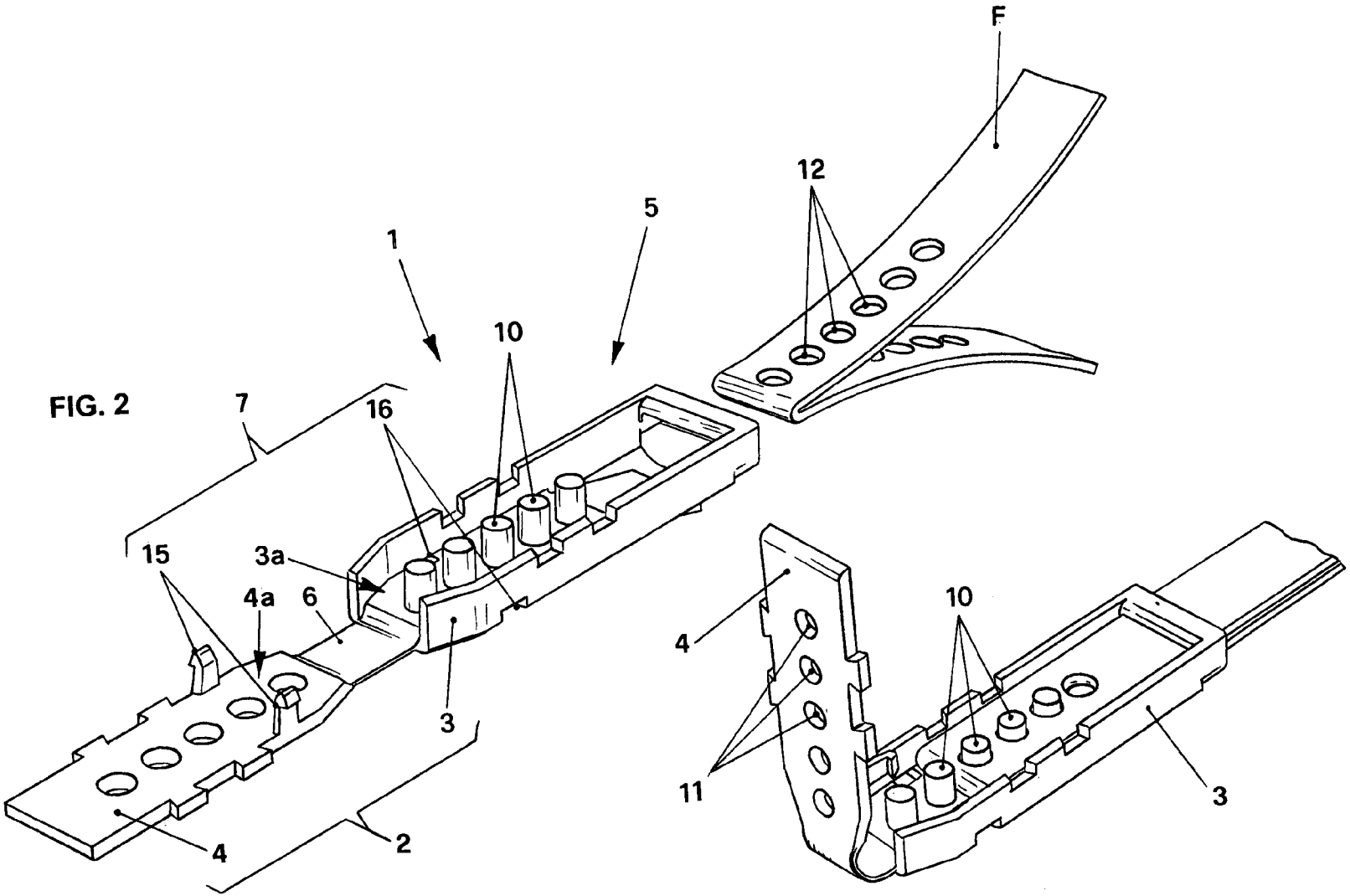
FIG. 2 shows an axonometric view of the buckle of the invention when open.
FIG. 5 shows the buckle of the invention in a half-open position during its connection to the tape.

According to the invention, the buckle 1 consists of a body 2, as illustrated in FIG. 2, comprising an outer jaw 3 and an inner jaw 4 between which it is possible to identify locking means 5 that co-operate with a tape F, attached to the wrist strap P and arranged in different positions between the jaws 3 and 4 in order to lock the wrist strap P at different distances from the handgrip M of the pole B.

Figure 3:
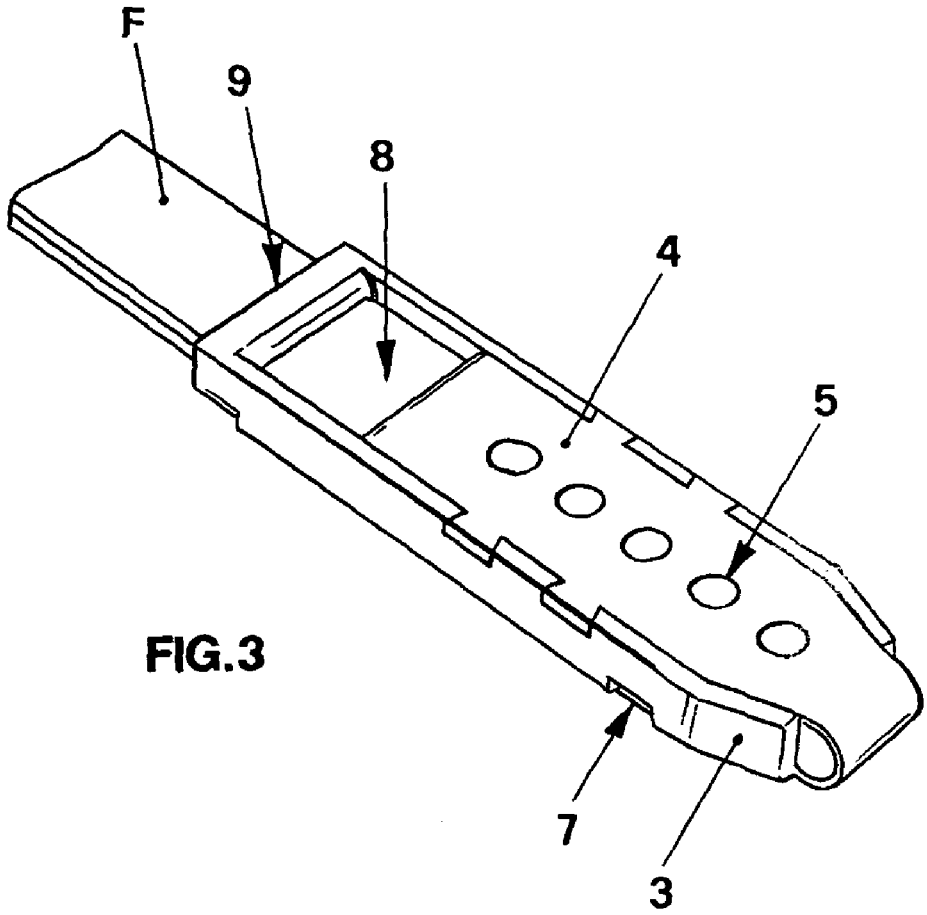
FIGS. 3 and 4 show two different axonometric views of the buckle of the invention when closed.
Figure 4:
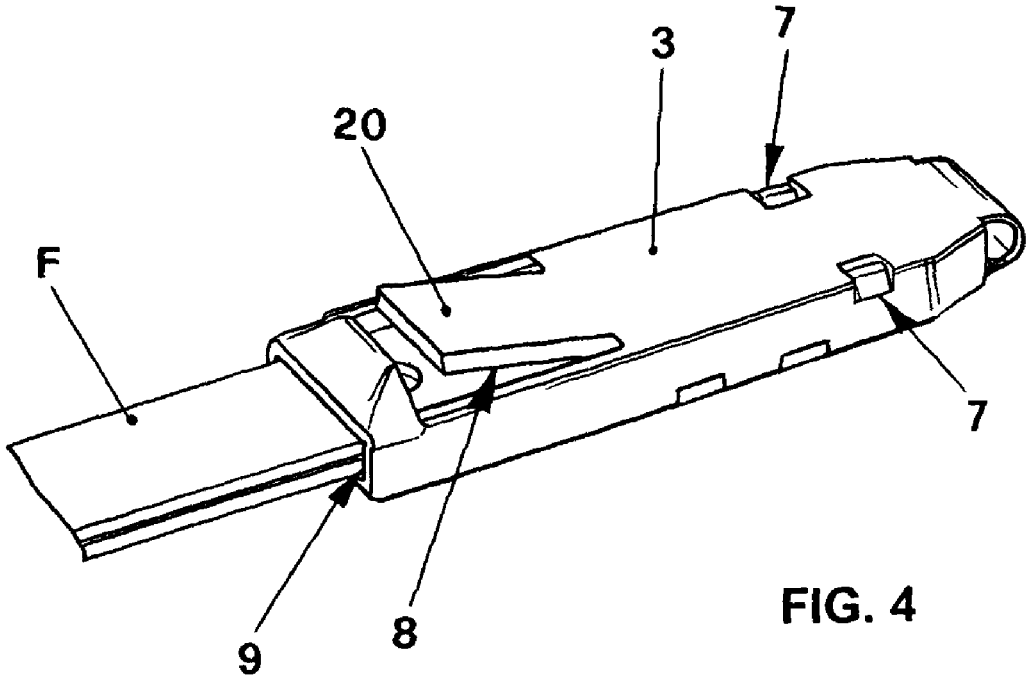

According to the preferred embodiment of the invention described herein, the jaws 3 and 4 are connected together at their respective ends 3*a*, 4*a* by hinge means 6, which enable a pivotal movement between the two jaws 3 and 4. To be more precise, the hinge means 6 consist of a flexible sheet element. The outer jaw 3 and inner jaw 4 are complete, as shown in FIGS. 3 and 4, with hooking means 7 that connect the two jaws together when they are juxtaposed.

In said condition, they define a cavity 8 with an opening 9 for the tape F, which is retained inside the cavity by the locking means 5 contained therein.

As shown in FIGS. 2 and 5, these locking means 5 comprise a plurality of pins 10, projecting from the outer jaw 3 and aligned one after the other, which come to bear on a corresponding plurality of through holes 11 in the inner jaw 4.

In accordance with this embodiment, the tape F has a stretch of its length with a plurality of through holes 12 suitable for engaging with the pins 10.

Figure 6:
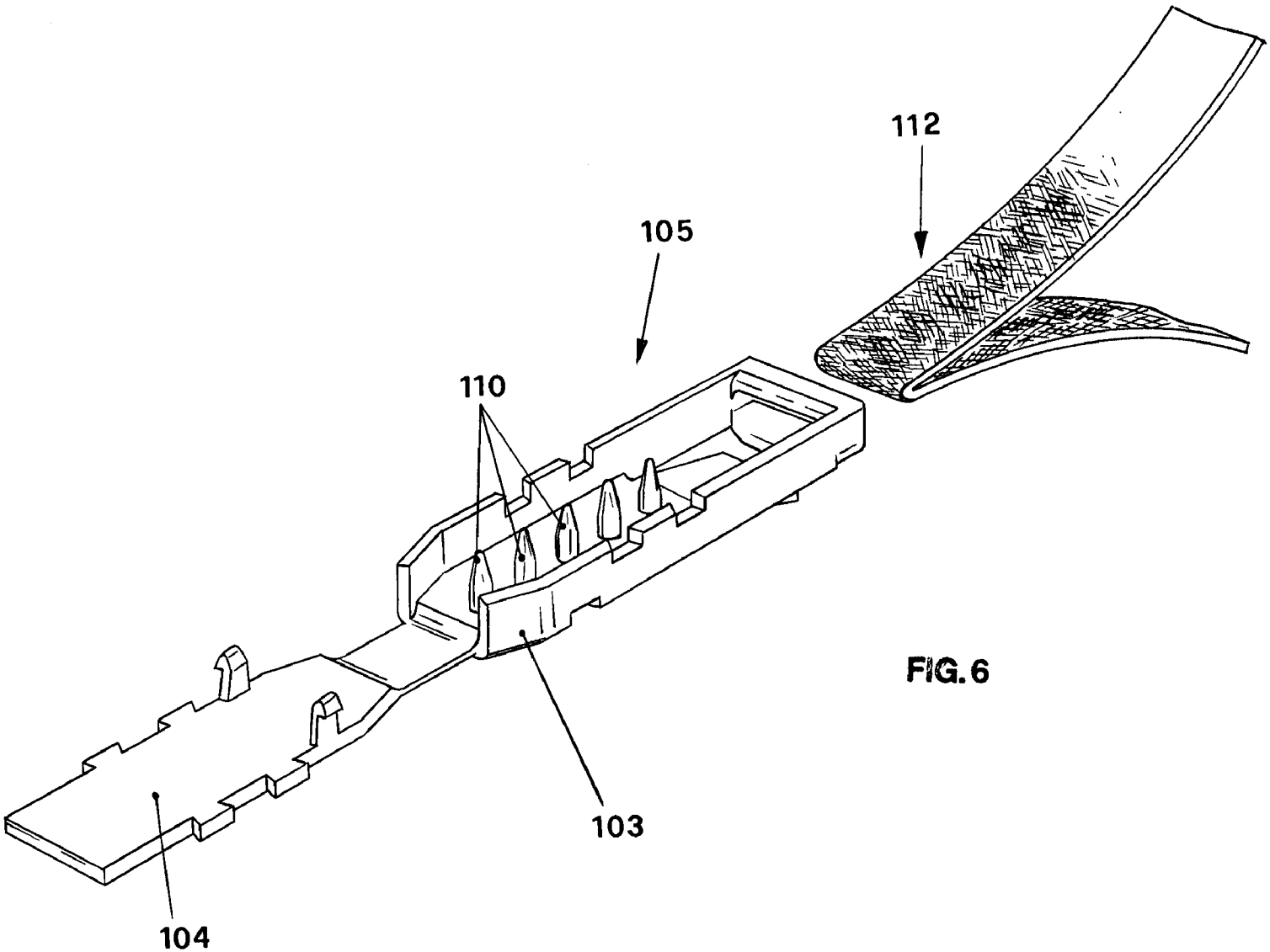
FIGS. 6 and 7 show some design variants of the buckle that is the subject of the invention.

According to another embodiment of the invention, illustrated in FIG. 6 and indicated by the numeral 100, the locking means 105 may consist of a plurality of pointed tips 110, projecting from the outer jaw 103 and aligned one after the other, whereon the inner jaw 104 rests.

In this case, a stretch of the length of the tape F consists of a plurality of woven thread-shaped elements 112 such that the resulting section of mesh comes to rest on the plurality of projecting tips 110.

Figure 7:
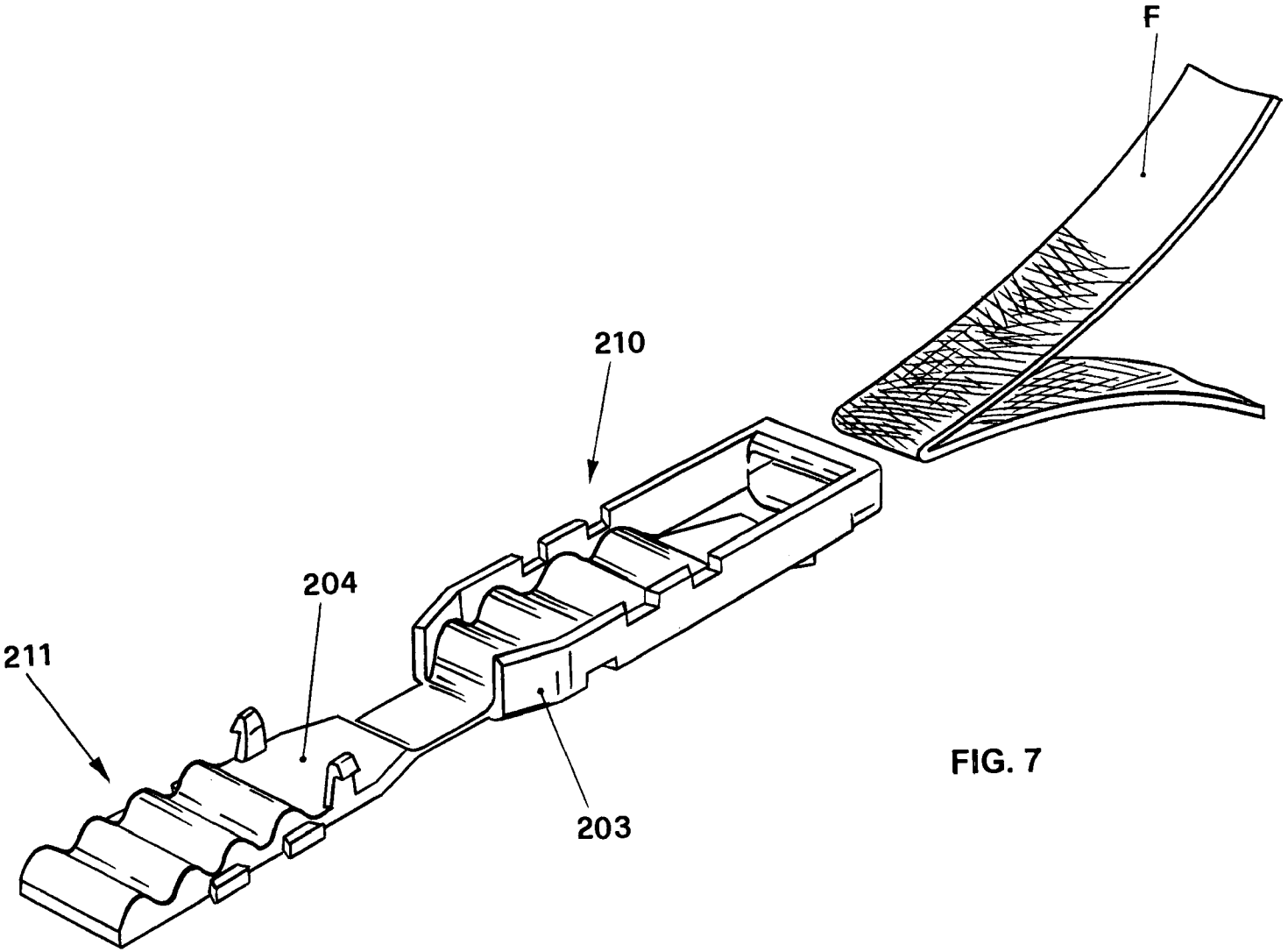

According to a further embodiment of the invention, illustrated in FIG. 7 and indicated by the numeral 200, the locking means may consist of a corrugated profile 210 in the outer jaw 203 with a corresponding corrugated profile 211 in the inner jaw 204, which lock the tape F between them by friction.

The hooking means 7 are snap fastenings consisting, as illustrated in FIG. 2, of hooks 15 projecting from the inner jaw 4 that fit into corresponding seats 16 provided in the outer jaw 3.

The body 2 of the buckle 1 that is the subject of the invention is substantially in the shape of a box, as shown in FIG. 1.

Moreover, it comprises fixing means 20 for retaining it inside a recess 21 in the handgrip M.

The connection between the wrist strap P and the handgrip M is thus advantageously achieved by means of the buckle I that, being adjustable, enables the displacement of the tape F inside the cavity 8, thereby permitting different distances to be obtained between the wrist strap P and the handgrip M.

In practice, the user opens the buckle 1 by rotating the inner jaw 4 away from the outer jaw 3 and then inserts the tape F between the two jaws so that the through holes 12 on the tape F engage on the pins 10 projecting from the outer jaw 3.

The user then closes the inner jaw 4 against the outer jaw 3, thereby engaging the hooking means 7, i.e. sliding the hooks 15 into the outer jaw 3 until they snap into the corresponding seats 16 provided in said outer jaw 3.

The user subsequently inserts the buckle 1 in the handgrip M, thereby effectively achieving the connection between the wrist strap P and the handgrip M.

If the distance between the wrist strap P and the handgrip M is not right for the user's wrist, the user withdraws the buckle 1 from the handgrip M by pressing on the fixing means 20 provided on the buckle 1, then opens the buckle 1 once again in order to be able to detach the tape F from its current position and move it to a different position.

Finally, the user snaps the inner jaw 4 into the outer jaw 3 once again and re-inserts the buckle 1 in the recess 21 in the handgrip M.

In the light of the above, the buckle carried out according to the invention achieves all the previously-stated objects.

In particular, the buckle of the invention achieves the object of connecting a wrist strap to the handgrip of a pole for use in sporting activities, enabling the user to adjust the distance between the wrist strap and the handgrip so as to ensure the most suitable posture for the wrist and hand.

Moreover, the invention achieves the object of producing a buckle for connecting a wrist strap to the handgrip of a pole for sporting activities that enables the user to regain control of said handgrip as rapidly as possible after losing his/her grip.

In the construction stage, further variants of the wrist strap of the buckle of the invention may be carried out, and they shall all be deemed as protected by the present patent, even though they have not been illustrated or described herein, provided that they come within the scope of the following claims.

The invention claimed is:

1. A buckle for connecting a wrist strap to a handgrip of a pole used for sporting activities, comprising a body having opposing first and second jaws on which are disposed respective first and second sets of cooperative locking elements, wherein the locking elements are adapted to cooperate adjustably with a tape forming part of said wrist strap to fix a selectable length of the tape within the jaws, in order to retain said wrist strap at a selectable one of a plurality of different distances from said handgrip, wherein said first set of locking elements includes blunt-tipped projections adapted to engage selected through holes in the length of tape, wherein said first and second jaws include hook elements adapted to connect the first and second jaws together with the cooperative locking elements arranged therebetween, thereby creating a cavity between the first and second jaws containing said locking elements and forming an opening allowing insertion of said tape within the cavity.

2. The buckle according to claim 1, wherein said first and second jaws are connected together at one end by a hinge element adapted to enable mutual pivotal movement of the first and second jaws.

3. The buckle according to claim 2, wherein said hinge element includes a flexible sheet element.

4. The buckle according to claim 1, wherein said first set of locking elements comprise a plurality of sequentially-aligned pegs projecting from said first jaw, adapted to engage with a plurality of corresponding through holes provided in said second jaw when the first and second jaws are connected together.

5. The buckle according to claim 4, wherein the plurality of pegs are adapted to engage a corresponding plurality of sequentially-aligned through holes in the length of tape.

6. The buckle of claim 4, wherein the plurality of sequentially-aligned pegs is a row of pegs.

7. The buckle according to claim 1, wherein said hook elements comprise snap-in fasteners consisting of hooks projecting from said second jaw that are adapted to snap into corresponding seats in said first jaw.

8. The buckle according to claim 1, wherein said body comprises fixing elements adapted to engage within a recess provided in said handgrip.

9. The buckle according to claim 1, wherein said body is substantially box-shaped.

10. The buckle according to claim 9, wherein said substantially box-shaped body includes a framed opening at an end of one of said first and second jaws that accepts the tape for engagement with the locking elements inside the body between the jaws.

11. A wrist strap adapted to removably couple to a handgrip of a pole for use in sporting activities, comprising a tape and an associated buckle adapted to removably connect to said handgrip, wherein said buckle comprises a body including at least two opposing elements including locking elements disposed between the opposing elements and adapted to fix an end of the tape in a selectable one of a plurality of different positions in order to retain said wrist strap at a selected distance from said handgrip when the buckle is connected to the handgrip;

wherein the end of the tape includes a plurality of through holes; and wherein the locking elements include blunt-tipped projections that engage selected ones of the through holes to fix a length of the tape that is retained between the opposing elements.

12. The wrist strap according to claim 11, wherein said body is substantially box-shaped and includes a framed opening at an end of one of said first and second jaws that accepts the tape for engagement with the locking elements inside the body between the jaws.

* * * * *